United States Patent [19]

Schötzau et al.

[11] Patent Number: 4,598,188

[45] Date of Patent: Jul. 1, 1986

[54] GAS-BLAST SWITCH

[75] Inventors: Hans-Jörg Schötzau, Unterentfelden; Renzo Coccioni, Niedergösgen; Christian Sturzenegger, Wettingen, all of Switzerland

[73] Assignee: Sprecher & Schuh AG, Aarau, Switzerland

[21] Appl. No.: 665,714

[22] Filed: Oct. 29, 1984

[30] Foreign Application Priority Data

Nov. 15, 1983 [CH] Switzerland ..... 6128/83

[51] Int. Cl.[4] ..... H01H 33/88

[52] U.S. Cl. ..... 200/148 A; 200/150 G

[58] Field of Search ..... 200/148 A, 150 G

[56] References Cited

U.S. PATENT DOCUMENTS 4,276,456 6/1981 Cromer et al. ..... 200/148 A

FOREIGN PATENT DOCUMENTS 0039096 11/1981 European Pat. Off. .
2604270 2/1977 Fed. Rep. of Germany .
2620675 11/1977 Fed. Rep. of Germany .
3009165 4/1981 Fed. Rep. of Germany .
587556 5/1977 Switzerland .

*Primary Examiner*—Robert S. Macon
*Attorney, Agent, or Firm*—Werner W. Kleeman

[57] ABSTRACT

A movable and a stationary contact element are tubularly structured for the purpose of axially discharging arc gases. A blast nozzle is associated in a fixed reference position with respect to one of the contact elements. A narrowest location or throat of the blast nozzle is positioned forwardly of the end of this one contact element and is closed by the other contact element in the cut-on position of the gas-blast switch. An inlet of the blast nozzle communicates with a pump space bounded by a cylinder and a piston. The contact element with which the blast nozzle is associated displaceably extends through the piston. The pump space can be pressurized during a cut-off stroke. Both of the contact elements are provided with related outlets in their related regions which are remote from the free ends of the contact elements. At least in the cut-off position the outlets interconnect an interior space formed in the related contact element and a blow-out space. In order to utilize the pressure pulses occurring due to a switching arc, for supporting the pressure prevailing in the pump space, the outlet of the contact element, with which the blast nozzle is associated, opens into the pump space in the cut-on position and the distance of this outlet from the free end of the related contact element is greater than the pumping stroke between the piston and the cylinder which occurs during the cut-off stroke.

9 Claims, 9 Drawing Figures

GAS-BLAST SWITCH

CROSS REFERENCE TO RELATED APPLICATION

This application is related to the commonly assigned, co-pending U.S. application Ser. No. 06/542,581, filed Oct. 17, 1983, and entitled "Gas Blast Switch".

BACKGROUND OF THE INVENTION

The present invention relates to a new and improved construction of gas-blast switch.

In its more particular aspects, the present invention specifically relates to a new and improved construction of a gas-blast switch comprising a moveable and a stationary contact element, both of which are substantially tube-shaped or tubularly constructed. A blast nozzle is associated in a fixed reference position with respect to one of the contact elements and the narrowest location or throat of the blast nozzle is positioned forwardly of this contact element and is closed by the other contact element in a cut-on position of the gas-blast switch. The blast nozzle has an inlet which communicates, during a cut-off stroke of the gas-blast switch, with a pressurizable pump space or chamber bounded by a cylinder and a piston through which displaceably extends the one contact element with which the blast nozzle is associated. Both the contact elements are provided in related regions which are remote from their free ends with related outlets which interconnect an interior space formed in the related contact element and a blow-out space in a cut-off position of the gas-blast switch.

In a gas-blast switch of such type as known, for example, from Swiss Patent No. 587,556, published on May 13, 1977, there starts, during the cut-off stroke and immediately after the contact elements have been separated from each other, an axially directed flow-off of the extinguishing gas, which is strongly heated by the arc and subjected to additional pressure, through the two contact elements into the blow-out space. Particularly during the cut-off of strong currents the additionally pressurized extinguishing gas retroacts on the pump space, whereby very high pressure peaks occur which have to be overcome at any rate by the drive means for the gas-blast switch. Therefore, the drive means in the known gas-blast switch have to be powerfully and massively constructed such that a faultless movement of the contact elements is also ensured during the cut-off of very strong currents.

Other constructions of gas-blast switches have been disclosed in the commonly assigned Swiss Patent No. 568,649, published Oct. 31, 1975 and Swiss Patent No. 570,694, published Dec. 15, 1975.

SUMMARY OF THE INVENTION

Therefore, with the foregoing in mind, it is a primary object of the present invention to provide a new and improved construction of a gas-blast switch in which part of the pressure pulse caused by the arc is utilized to assist the blowing action on the arc, whereby the drive means of the gas-blast switch can be of lighter construction without impairing the reliability thereof.

Now in order to implement this and still further objects of the invention, which will become more readily apparent as the description proceeds, the gas-blast switch of the present development is manifested by the features that, the outlet in the one contact element with which the blast nozzle is associated, opens into the pump space in the cut-on position of the gas-blast switch, the distance of this outlet from the free end of said one contact element is greater than the pumping stroke between the piston and the cylinder occurring during the cut-off stroke of the gas-blast switch such that this outlet enters into flow communication with the blow-out space only at the end of the cut-off stroke, and the volume of the pump space in the cut-off position is in the range of about $\frac{1}{2}$ to $\frac{1}{3}$ of the volume thereof in the cut-on position.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Describing now the drawings, it is to be understood that only enough of the construction of the gas-blast switch has been shown as needed for those skilled in the art to readily understand the underlying principles and concepts of the present development, while simplifying the showing of the drawings. Specifically, there are shown only those components of the gas-blast switch which are significant in the present context of the disclosure of the invention and in the sectional drawings these components are shown in their cut-on position on the left-hand side while they are shown in their cut-off position on the right-hand side of such drawings.

Figure 1:
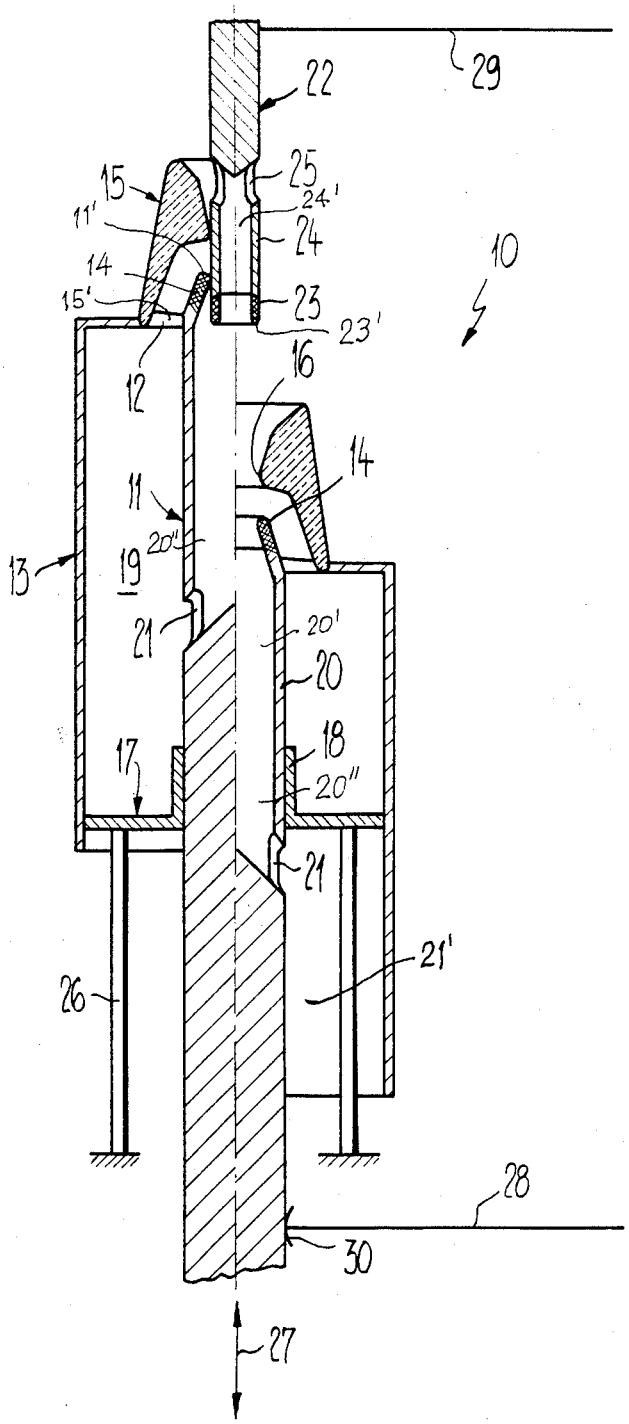
FIG. 1 schematically shows a section through the components of a simple first exemplary embodiment of the gas-blast switch according to the invention.

Turning now specifically to the sectional illustration of FIG. 1 of the drawings, there have been shown the components of a first exemplary embodiment of a gas-blast switch 10 which should be imagined as arranged in a not particularly illustrated, encased or encapsulated housing providing a blow-out space generally indicated by reference character 21′ and containing an extinguishing gas like sulfur hexafluoride under excess pressure. There will be recognized in FIG. 1 a first substantially tube-shaped or tubular contact element 11 to which a cylinder 13 is connected via webs 12. The cylinder 13 defines an outlet between the webs or struts 12 which, at the same time, forms the inlet 15′ of a blast nozzle 15 which is mounted to the bottom or floor of the cylinder 13 and surrounds the free end of the contact element 11 which is provided with a burn-off ring 14. The narrowest location or throat 16 of the blast nozzle 15 is positioned forwardly of the burn-off ring 14. The blast nozzle 15 is made of plastic or any other appropriate electrically insulating material. The blast nozzle 15 thus is operatively associated in a fixed reference position with the contact element 11. This contact element 11 displaceably extends through a piston 17 at which a guiding sleeve 18 is mounted or with which the guiding sleeve 18 is integrally formed. The guiding sleeve 18 sealingly surrounds the contact element 11. The piston 17 and the cylinder 13 thus bound a pump space or chamber 19 which is pressurizable during a cut-off stroke of the gas-blast switch and which also contains the extinguishing gas. The inlet 15′ of the blast nozzle 15 flow communicates with the pump space or chamber 19.

The contact element 11 is not tubularly structured throughout its entire length but only in a section 20 which is contiguous with the burn-off ring 14. This substantially tubular section 20 defines an interior or inner space 20′ and in a region 20″ thereof which is remote from the free end 11′ of the contact element 11, there are provided substantially radial outlets 21 which interconnect the interior space 20′ of the tubular section 20 with the environment of the contact element 11 which is the pump space 19 in the cut-on position and the blow-out space 21′ in the cut-off position of the gas-blast switch.

A contact element 22 coacts with the contact element 11 and also comprises a free end 23′ provided with a burn-off ring 23. This contact element 22 has a substantially tubular section only in the portion following the free end 23′ and an interior or inner space 24′ is defined in this tubular section. In a region 24 of the substantially tubular section which is remote from the free end 23′ of the contact element 22 there are present outlets 25 which connect the interior space 24′ with the environment of the contact element 22, i.e., with the blow-out space 21′. In the cut-on position of the gas-blast switch the contact element 22 closes off the blast nozzle 15 at the narrowest location or throat 16 thereof and also the free end 11′ of the contact element 11.

In the first embodiment of the gas-blast switch illustrated in FIG. 1, the piston 17 is stationarily supported, for example, at columns or supports 26, whereas the contact element 11 and thus also the cylinder 13 and the blast nozzle 15 are moveable. For this purpose the moveable contact element 11 is coupled to a here not particularly illustrated but conventional drive means, like the drive means 43 shown in FIGS. 7 to 9, by means of which the moveable contact element 11 is displaceable between the cut-on position and the cut-off position as indicated by the bi-directional arrow 27. Just as was the case for the piston 17 also the contact element 22 is stationarily arranged. The connections 28 and 28 which lead to the related contact elements 11 and 22 are only schematically indicated; the connection 28 to the movable contact element 11 is additionally provided with a slide contact or wiper 30.

During the cut-off stroke of the gas-blast switch the moveable contact element 11 moves away from the stationary contact element 22. However, before the two contact elements 11 and 22 depart from each other, the extinguishing gas which is present in the pump space or chamber 19 is already pre-compressed to some extent. As soon as these two contact elements 11 and 22 separate from each other, there is drawn a switching arc of an intensity which depends upon the strength of the cut-off current. There is now exerted a blowing action on the switching arc even if the blast nozzle 15 is still closed by the stationary contact element 22. The switching gases formed during this period mainly flow off axially through the outlets 25 in the stationary contact element 22. If, however, the switching arc is particularly intense so that the pressure of the highly pressurized switching gases exceeds the pressure of the pre-compressed extinguishing gas in the pump space 19, a pressure wave will propagate through the tubular section 20 and the outlets 21 and additionally increases the already prevailing pressure in the pump space 19. When the blast nozzle 15 comes out of contact with the stationary contact element 22, the blowing action on the switching arc is abruptly intensified, particularly because the aforedescribed pressure augmenting action via the outlets 21 still persists until these outlets 21 enter the guiding or guide sleeve 18 and are closed thereby. At this moment the axial flow through the tubular section 20 temporarily ceases and there is formed a pressure back-up in this tubular section 20 depending on the intensity of the switching arc. The pressure back-up is later relieved when the outlets 21 exit from the guiding sleeve 18 close to the end of the cut-off stroke.

It will be evident from the drawing of FIG. 1 that the outlets 21 are spaced from the free end 11′ of the movable contact element 11 to which the blast nozzle 15 is associated, by a distance which is greater than the pumping stroke performed during the cut-off stroke by the cylinder 13 and the piston 17. As a result, the outlets 21 communicate with the blow-out space 21′ only close to the end of the cut-off stroke. It should be noted that the volume of the pump space 19 is still significant in the cut-off position, namely its volume is still in the range of about $\frac{1}{2}$ to about $\frac{1}{3}$ of the original volume of the pump space 19 in the cut-on position of the gas-blast switch. Thus, there remains in the pump space or chamber 19 a gas cushion or buffer which suffices under all conditions to effectively dampen or attenuate the retroactions of the pressure peaks originating from the switching arc on the drive means of the gas-blast switch. In other words, the switching stroke is significantly shorter than the theoretically feasible pumping stroke.

Figure 2:
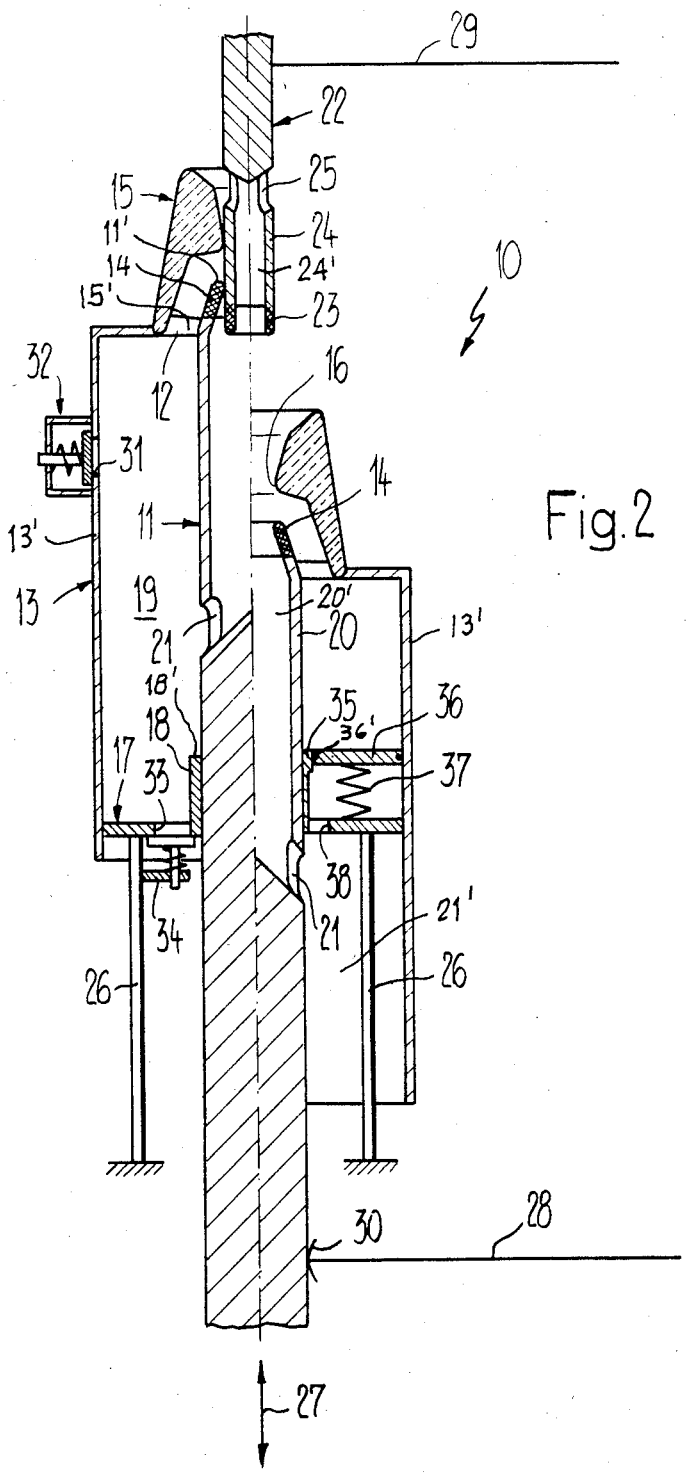
FIG. 2 is section, similar to the illustration of FIG. 1, through a second embodiment of the inventive gas-blast switch provided with additional means for limiting the pressure in the pump space thereof.

The second exemplary embodiment of the inventive gas-blast switch illustrated in section in FIG. 2 widely corresponds to the first exemplary embodiment shown in FIG. 1. As a difference therefrom there are provided in this embodiment additional pressure limiting means in order to prevent the pressure prevailing in the pump space or chamber 19 from increasing above a predetermined value.

As will be recognized in FIG. 2 on the left-hand side thereof, the pressure limiting means constitute, for instance a pressure relief valve 32 which is mounted at the wall 13′ of the cylinder 13 and frees a lateral outlet 31. The pressure relief valve 32 thus interconnects the pump space 19 and the blow-out space 21′ when the predetermined pressure is exceeded in this pump space 19. In the illustrated embodiment there is additionally provided a further pressure relief valve 34 which is mounted at the piston 17 and frees a passage 33 therein which interconnects the pump space 19 and the blow-out space 21' when a predetermined pressure is exceeded in the pump space 19 whereupon the passage 33 is freed or opened by the pressure relief valve 34. It is sufficient to provide only one of the pressure relief valves 32, 34. However, if pressure relief valves are provided at the cylinder 13 as well as at the piston 17 it is preferable to adjust both pressure relief valves to the same response pressure.

Further pressure limiting means which are employed instead of the pressure relief valves 32 and/or 34 are shown in the right-hand half of FIG. 2. These further pressure limiting means also serve to limit the pressure prevailing in the pump space or chamber 19. In this embodiment the guiding sleeve or guide 18 is anchored at the piston 17. Substantially at a free end 18' of the guiding sleeve 18 there is integrally formed therewith a protruding collar 35 which is normally sealingly surrounded and engaged by the inner rim or margin 36' of an annular piston or piston member 36. This annular or ring-shaped piston or piston member 36 also sealingly engages the inside of the wall 13' of the cylinder 13 and is supported at the piston 17 by means of a spring 37 on a side thereof which faces the pump space 19. In this particular structure of the pressure limiting means, the piston 17 comprises passage means 38 which may be formed by an annular arrangement of outlets at the root or bottom of the sleeve 18. When the pressure prevailing in the pump space 19 can overcome the force of the spring 37, the annular piston 36 is displaced at the guiding sleeve 18 towards the piston 17. The annular piston 36 thus also comes out of contact with the collar 35 and an annular gap or passage 38' (see FIG. 4) is formed intermediate the guiding sleeve 18 and the interior rim or margin of the annular piston 36. Through this annular gap or passage 38' the excess pressure can escape from the pump space 19 until the spring 37 is again able to push the annular piston 36 to the level of the collar 35.

Also in the modified embodiment shown on the right-hand side of FIG. 2, the volume of the pump space 19 in the cut-off position is still somewhat greater than $\frac{1}{3}$ of the volume of the pump space 19 in the cut-on position, so that there is again ensured the aforementioned damping or attenuating action of the gas cushion remaining in the pump space 19.

Figure 3:
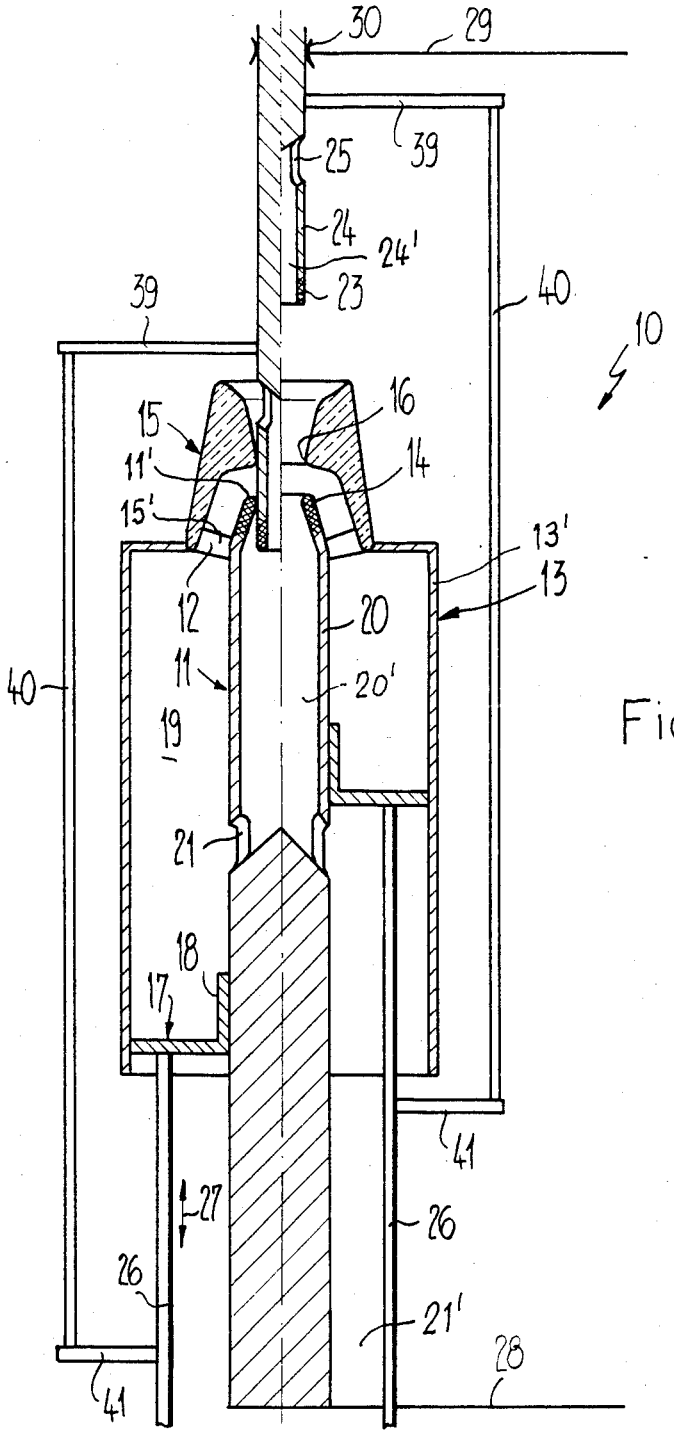
FIG. 3. schematically shows a section through a third embodiment of the gas-blast switch according to the invention.

The third exemplary embodiment of the inventive gas-blast switch shown in FIG. 3 can be considered to some extent as a kinematic reversal of the first embodiment shown in FIG. 1. In this embodiment the contact element 11 and therewith the cylinder 13 as well as the blast nozzle 15 are stationarily supported at not particularly illustrated support means.

In contrast to the first embodiment shown in FIG. 1 the columns or supports 26 carrying the piston 17 are coupled to the switch drive means which thus move the piston 17 between the cut-on position and the cut-off position as indicated by the bi-directional arrow 27. The movable contact element 22 is fixedly coupled to the columns or supports 26 and thus to the drive means by a bracket 39 protruding from the contact element 22, by push-and-pull rods 40 made of suitable electrically insulating material as well as by further brackets 41 laterally protruding from the columns or supports 26. The mode of operation of this embodiment extensively corresponds to the embodiment illustrated in FIG. 1; however, it is noted that it is possible in this embodiment to maintain smaller the masses to be accelerated and to be moved by the drive means of the gas-blast switch than those in the embodiment as shown in FIG. 1 which, in turn, permits a reduction in the power output of the drive means. Also in the third embodiment illustrated in FIG. 3 the pump space or chamber 19 occupies a still significant volume in the cut-off position of the gas-blast switch.

Figure 4:
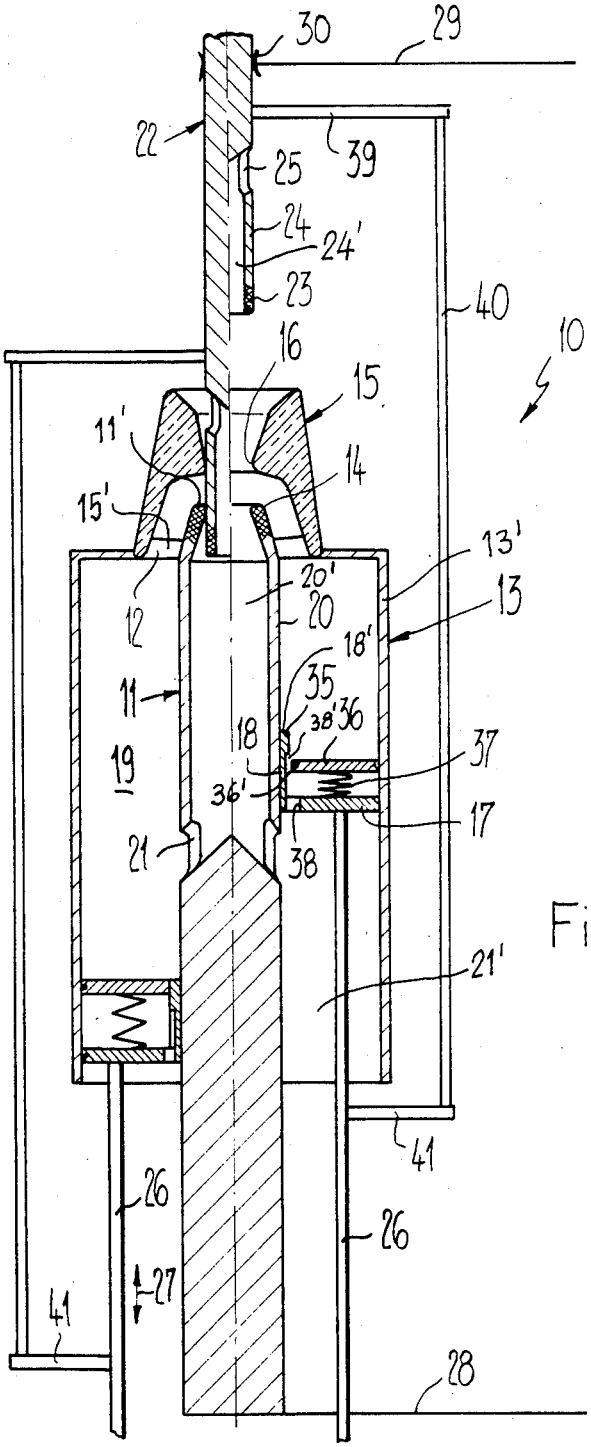
FIG. 4 is a section through the gas-blast switch shown in FIG. 3 and including additional means for limiting the pressure in the pump space thereof.

The fourth exemplary embodiment of the inventive gas-blast switch shown in FIG. 4 widely corresponds to the third exemplary embodiment shown in FIG. 3 except for the difference that the fourth embodiment shown in FIG. 4 is provided with pressure limiting means for limiting the pressure prevailing in the pump space or chamber 19 as described with reference to the right-hand side of FIG. 2. On the right-hand side in FIG. 4 there will be recognized in which manner the annular piston 36 has been displaced from the collar 35 at the guiding sleeve 18 against the action of the spring 37, so that the pump space 19 is connected to the remaining space through the annular gap or passage 38' between the interior rim or margin 36' of the annular piston 36 and the neck portion of the guiding sleeve 18 and through the passage means 38 in the piston 17.

Figure 5:
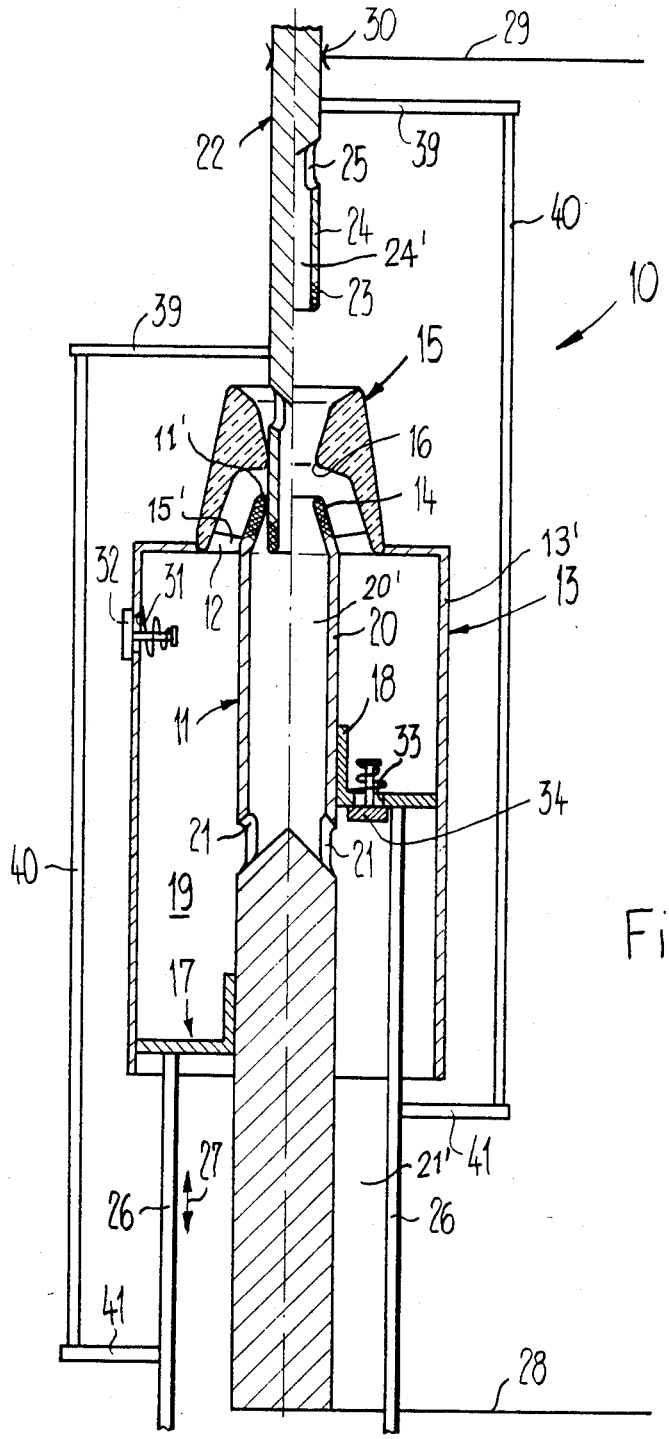
FIG. 5 is a section through the gas-blast switch shown in FIG. 3 and shows different means for limiting the pressure in the pump space thereof.

The fifth exemplary embodiment of the inventive gas-blast switch shown in FIG. 5 substantially corresponds to the fourth exemplary embodiment shown in FIG. 4. Similar to the illustration on the left-hand side of FIG. 2 the means for limiting the pressure in the pump space or chamber 19 are, in this case, pressure relief valves 32 and 34 which are mounted at the wall 13' of the cylinder 13 and/or at the piston 17 and which, in turn, free the passage 31 in the cylinder wall 13' and the outlet 33 in the piston 17, respectively.

Figure 6:
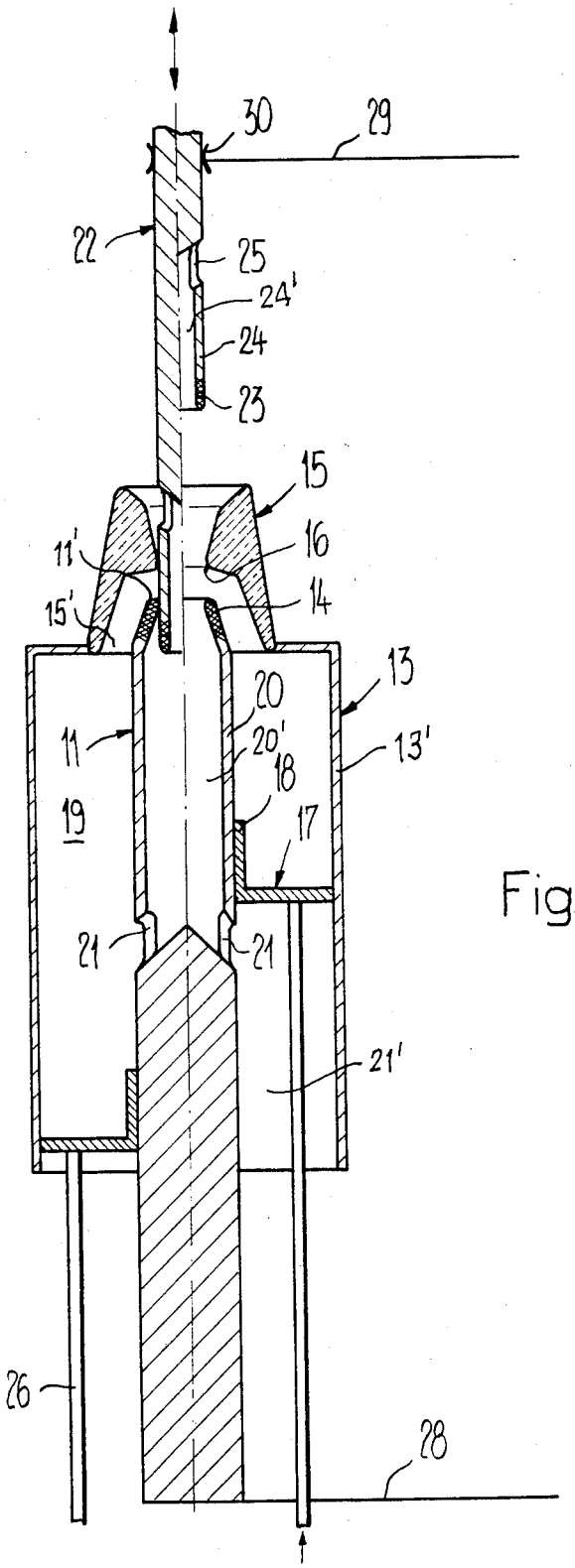
FIG. 6 is a section through a fourth embodiment of the gas-blast switch according to the invention in which, using the same switch drive means, the moveable contact element only is displaced after pre-compression has already occurred in the pump space of the gas-blast switch.

The sixth exemplary embodiment of the inventive gas-blast switch shown in FIG. 6 is similar to the embodiments illustrated in FIGS. 4 and 5; however, in this embodiment the movable contact element 22 and the here also movable piston 17 are coupled to one and the same drive means, however, via different linkages or the like. Also there are provided in this embodiment pressurizing means in order to pressurize the pump space or chamber 19 during the cut-off stroke prior to a displacement of the movable contact element 22. An example of the different linkages and their operation are illustrated in FIGS. 7 to 9.

Figures 7, 8, 9:
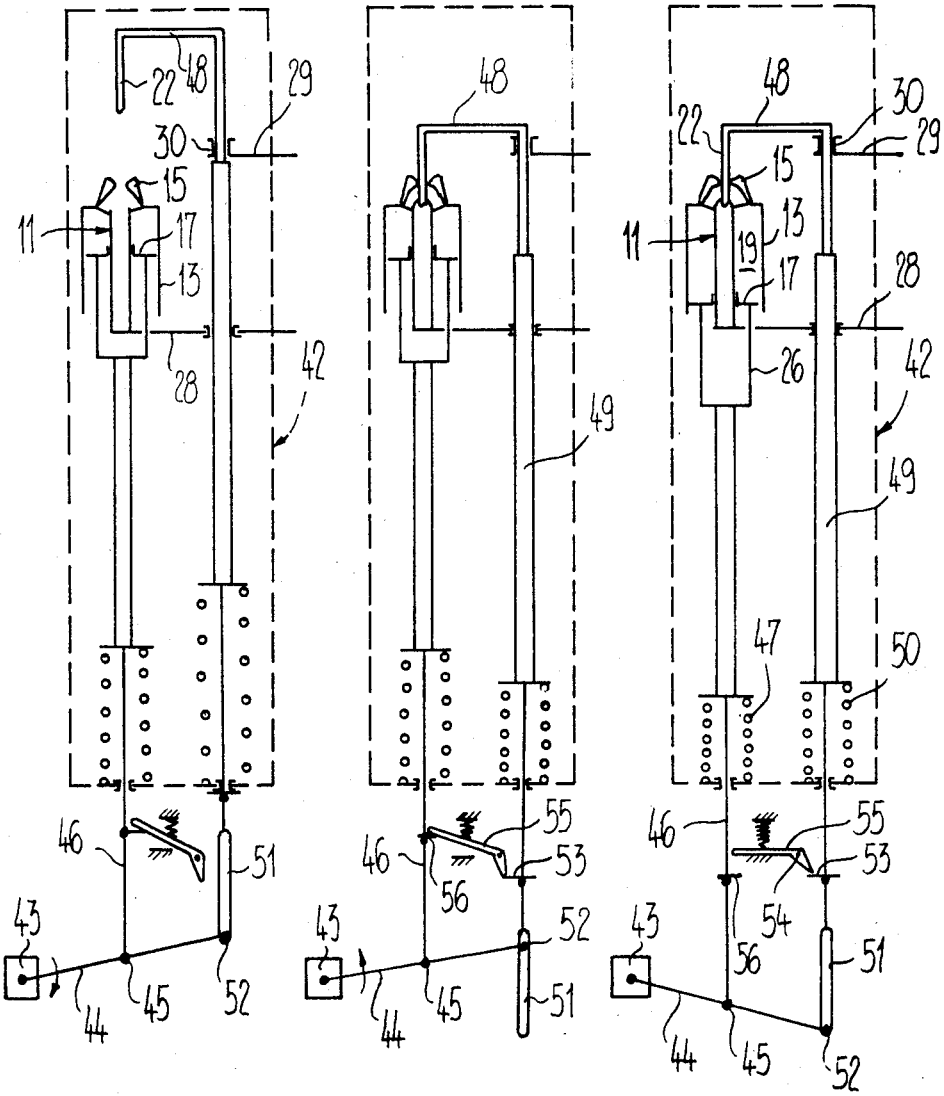
FIGS. 7 to 9 diagramatically illustrate an example of the coupling of the moveable contact element and of the pump actuation to a switch drive of the gas-blast switch shown in FIG. 6.

There will be recognized in FIGS. 7 to 9 the only schematically illustrated components of FIG. 6, however, these components are conveniently designated by the same reference characters as in FIG. 6. There will be further recognized a drive unit or drive means 43 which is arranged outside a switch housing 42 indicated in broken lines. A pivot lever 44 extends from the drive unit 43. At the location 45 of the pivot lever 44 there is linked one end of a rod or link 46 which is sealingly, but displaceably, introduced into the housing 42. At its other end the rod 46 carries the columns 26 at which the piston 17 is anchored. The rod 46 is thus associated with the piston 17 and is under the action of a compression spring 47 which is in the tensioned state in the cut-on position shown in FIG. 7 and which tends to have the rod 46 and thus also the piston 17 execute the movement or displacement required for the cut-off stroke.

The movable contact element 22 is connected via a bracket 48 to one end of a further rod or link 49 which is substantially parallel to the rod 46. The rod 49 also is under the action of a compression spring 50 which is in a tensioned state in the cut-on position shown in FIG. 7 and the rod 49 extends sealingly, but displaceably from the housing 42. At the end of the rod 49 which is located outside the housing 42 the rod 49 is provided with an elongated hole or slot 51 into which engages a pin 52 which is anchored at the end of the pivot lever 44. Furthermore, there is mounted at the rod 49 a ratchet or blocking dog 53 or equivalent structure which cooperates with one arm of a two-armed pawl 55 pivotably mounted at the location designated by reference numeral 54. The other arm of this pawl 55 extends close to the rod 46 at which a release stop or dog 56 is mounted.

For a cut-off stroke the pivot lever 44 is rotated in counterclockwise direction as indicated by the not particularly referenced arrow in FIG. 8. Due to this movement there is initially only displaced the rod or link 46 and conjointly therewith the piston 17 which thus acts as pressurizing means causing a pre-compression of the extinguishing gas present in the pump space or chamber 19. During this movement the further rod or link 49 and thus also the movable contact element 22 remain arrested due to the pawl 55, and the pin 52 slides in the elongated hole 51 in the direction towards the ratchet or blocking dog 53. When the pivot lever 44 arrives at substantially the position illustrated in FIG. 8, the release stop or dog 56 at the rod 46 lifts the arm of the two-armed pawl 55 which is directed thereto. Consequently, the pawl 55 is pivoted in clockwise direction until the other arm of the pawl 55 releases the ratchet or blocking dog 53 at the further rod or link 49. From this moment on the compression spring 50 can be released without hindrance and the further rod 49 and thus the movable contact element 22 even lead or move ahead of the displacement of the pivot lever 44: the cut-off stroke is now in full swing while the piston 17 practically has already arrived at its final or end position.

The cut-off position is illustrated in FIG. 9. The pin 52 again engages one end of the elongated hole or slot 51 as shown in FIG. 7. The cut-on stroke starts from the cut-off position as illustrated in FIG. 9 and during the cut-on stroke the pivot lever 44 performs a clockwise rotation. During this rotation both the rod 46 and the further rod 49 are simultaneously withdrawn from the housing 42, the compression springs 47 and 50 are simultaneously tensioned and the ratchet or blocking dog 53 overruns the associated arm of the pawl 55 until substantially the position shown in FIG. 7 is arrived at.

Also in the sixth exemplary embodiment of the inventive gas-blast switch illustrated in FIG. 6 and in FIGS. 7 to 9, there can be additionally provided pressure limiting means in order to limit the pressure prevailing in the pump space or chamber 19.

While there are shown and described present preferred embodiments of the invention, it is to be distinctly understood that the invention is not limited thereto, but may be otherwise variously embodied and practiced within the scope of the following claims. Accordingly,

What is claimed is:

1. A gas-blast switch comprising:

two contact elements constituting a movable contact element and a stationary contact element;

each one of said two contact elements possessing a substantially tubular structure;

a blast nozzle having an inlet and being operatively associated in a fixed reference position with respect to one of said two contact elements;

said blast nozzle defining a narrowest location positioned forwardly of said one contact element;

said narrowest location of said blast nozzle being closed by the other one of said two contact elements in a cut-on position of the gas-blast switch;

means defining a pump space pressurizable during a cut-off stroke of the gas-blast switch;

said inlet of said blast nozzle flow communicating with said pump space;

said means defining said pump space including a cylinder;

a piston through which displaceably extends said one contact element with which said blast nozzle is operatively associated;

said cylinder and said piston bounding said pump space;

each one of said two contact elements possessing a related free end and a related region remote from said free end;

at least one outlet provided at said related region of each one of said two contact elements;

each one of said two contact elements defining a related interior space;

a blow-out space;

each said at least one outlet provided in said related region of each one of said two contact elements, interconnecting said interior space of its related one of said two contact elements and said blow-out space at least in a cut-off position of the gas-blast switch;

said at least one outlet provided in said region remote from said free end of said one contact element with which said blast nozzle is operatively associated, opening into said pump space in said cut-on position of the gas-blast switch;

said cylinder and said piston defining a pumping stroke during said cut-off stroke of the gas-blast switch;

said at least one outlet provided in said region of said one contact element with which said blast nozzle is operatively associated, being spaced from said free end of said one contact element by a distance which is greater than said pumping stroke such that said at least one outlet enters into flow communication with said blow-out space only close to the end of said cut-off stroke; and said pump space defining a predetermined volume which in the cut-off position is in the range of about $\frac{1}{3}$ to about $\frac{1}{2}$ the volume of said pump space in the cut-on position.

2. The gas-blast switch as defined in claim 1, further including:

pressure limiting means limiting, the pressure prevailing in said pump space.

3. The gas-blast switch as defined in claim 2, wherein:

said pressure limiting means comprise at least one pressure relief valve; and said at least one pressure relief valve interconnecting said pump space and said blow-out space when a predetermined pressure is exceeded in said pump space.

4. The gas-blast switch as defined in claim 1, further including:

a guiding sleeve provided at said piston and sealingly surrounding said one contact element extending through said piston; and said guiding sleeve transiently closing said outlet provided in said region remote from the free end of said one contact element during the displacement of said one contact element during such time as the gas-blast switch is switched between said cut-on position and said cut-off position.

5. The gas-blast switch as defined in claim 4, further including:

passage means provided at said piston and opening into said blow-out space;

said at least one pressure reiief valve comprising an annular piston member resiliently supported at said piston on a side thereof which faces said pump space;

said annular piston member defining an inner rim;

said guiding sleeve being anchored at said piston;

said annular piston member being displaceable at said guiding sleeve;

said guiding sleeve defining a free end and comprising a collar in the region of said free end;

said collar sealingly engaging said inner rim of said annular piston member; and an annular passage defined between said annular piston member and said guiding sleeve and providing flow communication between said pump space and said blow-out space when said annular piston member responds in order to thereby limit the excess pressure prevailing in said pump space.

6. The gas-blast switch as defined in claim 1, further including:

pressurizing means for pressurizing said pump space during the cut-off stroke prior to displacement of said movable contact element.

7. The gas-blast switch as defined in claim 3, wherein:

said cylinder defines a wall; and said at least one pressure relief valve being mounted at said wall of said cylinder.

8. The gas-blast switch as defined in claim 3, wherein:

said at least one pressure relief valve is mounted at said piston.

9. The gas-blast switch as defined in claim 3, wherein:

said cylinder defines a wall;

said at least one pressure relief valve constitutes two pressure relief valves;

a first one of said two pressure relief valves being mounted at said wall of said cylinder; and a second one of said two pressure relief valves being mounted at said piston.

* * * * *

UNITED STATES PATENT AND TRADEMARK OFFICE

CERTIFICATE OF CORRECTION

PATENT NO. : 4,598,188

DATED : July 1, 1986

INVENTOR(S) : HANS-JÖRG SCHÖTZAU et al

It is certified that error appears in the above-identified patent and that said Letters Patent are hereby corrected as shown below:

Column 2, line 25, please insert --a-- after the word "is"

Column 3, line 66, please delete "28" (second occurrence) and insert --29--

Signed and Sealed this

Thirteenth Day of January, 1987

*Attest:*

DONALD J. QUIGG

*Attesting Officer*

*Commissioner of Patents and Trademarks*